US009140079B2

(12) United States Patent
Pøhner

(10) Patent No.: US 9,140,079 B2
(45) Date of Patent: Sep. 22, 2015

(54) COMPENSATOR

(71) Applicant: AKER MH AS, Kristiansand (NO)

(72) Inventor: Lars Pøhner, Horten (NO)

(73) Assignee: AKER MH AS, Kristiansand (NO)

( * ) Notice: Subject to any disclaimer, the term of this patent is extended or adjusted under 35 U.S.C. 154(b) by 0 days.

(21) Appl. No.: 14/352,629

(22) PCT Filed: Nov. 22, 2012

(86) PCT No.: PCT/EP2012/073389

§ 371 (c)(1),
(2) Date: Apr. 17, 2014

(87) PCT Pub. No.: WO2013/076207

PCT Pub. Date: May 30, 2013

(65) Prior Publication Data

US 2014/0246203 A1 Sep. 4, 2014

(30) Foreign Application Priority Data

Nov. 25, 2011 (NO) ..... 20111629

(51) Int. Cl.
*E21B 19/09* (2006.01)
*E21B 19/00* (2006.01)

(52) U.S. Cl.
CPC ..... *E21B 19/09* (2013.01); *E21B 19/004* (2013.01); *E21B 19/006* (2013.01)

(58) Field of Classification Search
CPC ..... E21B 19/09; E21B 19/04; E21B 19/006
USPC ..... 166/355; 175/5, 7, 10
See application file for complete search history.

(56) References Cited

U.S. PATENT DOCUMENTS

| | | | | |
|---|---|---|---|---|
| 3,511,476 | A * | 5/1970 | Horton | 254/392 |
| 3,881,695 | A * | 5/1975 | Joubert | 166/355 |
| 3,897,045 | A * | 7/1975 | Butler | 254/392 |
| 3,946,559 | A | 3/1976 | Stevenson | |
| 6,000,480 | A | 12/1999 | Eik | |
| 6,470,969 | B1 * | 10/2002 | Sørhaug et al. | 166/355 |
| 7,530,399 | B2 | 5/2009 | Dreelan | |
| 2007/0084606 | A1 * | 4/2007 | Ponville | 166/355 |
| 2009/0133881 | A1 * | 5/2009 | Roodenburg et al. | 166/355 |

FOREIGN PATENT DOCUMENTS

| | | |
|---|---|---|
| WO | WO 2004/001193 A2 | 12/2003 |
| WO | WO 2007/044924 A2 | 4/2007 |

* cited by examiner

*Primary Examiner* — James G Sayre
(74) *Attorney, Agent, or Firm* — Birch, Stewart, Kolasch & Birch, LLP

(57) ABSTRACT

A motion compensation system is provided for controlling relative movements between a floating vessel and an elongate element, where the elongate element is suspended by the vessel at a first end and extends into a body of water below the floating vessel. An active motion compensator is connected to the elongate element first end via an element arranged in an upper region of an erect support structure and a passive motion compensator is connected to the elongate element first end via the element. The motion compensators are structurally and operationally separate and independent units and are configured for separate and mutually independent operation.

19 Claims, 1 Drawing Sheet

COMPENSATOR

FIELD OF THE INVENTION

The invention pertains to oil and gas drilling, and related operations, from floating structures. More particularly, the invention concerns a motion compensation system as set out in the preamble of claim 1.

BACKGROUND OF THE INVENTION

Floating vessels (ships, platforms, etc.) are commonly used for drilling, servicing and maintenance of subsea oil and gas wells. Typically, a riser is suspended underneath a drill floor and extends to a subsea wellhead on the seabed. A drill string may be suspended by the drilling derrick and run inside the riser, through the wellhead and into a subterranean hydrocarbon reservoir. The distance (and hence drill string length) between the seabed wellhead and the reservoir may be considerable. In this configuration, the riser is fixed to the seabed (via the wellhead), while the drill string is not. A malfunctioning drill string or drill string compensator will therefore normally not compromise the integrity of the well, as the drill string runs inside the riser. The riser ensures that well is not open to the seawater.

The respective connections between the riser and vessel and between the drill string and the vessel must be compensated for the vessel's movement in the water. The predominant factors for causing vessel movements are waves and tidal currents, but drift could also be a factor if the vessel is not firmly anchored to the seabed. The distance between a fixed point on the vessel and a seabed wellhead will vary according to the magnitude of these factors.

Compensators are generally based on pressurized cylinders in a hydraulic-pneumatic system. This so-called passive compensator is in effect a spring with a predetermined (albeit adjustable) force. A passive compensator will in principle require no external utilities (e.g. electricity, control system, air or oil supply) during operation. The riser is normally suspended by a tensioner system underneath the drill floor. The drill string is normally suspended by a drill string compensator (hence often referred to as a "DSC") at the top of the derrick ("top-mounted compensator"), which is commonly known in the art In another operational configuration, the drill string (or casing) extends between the vessel and the seabed without a riser. The drill string may be connected to a x-mas tree and may in a context of compensation be considered to be fixed to the seabed. In this so-called "fixed-to-bottom" configuration, the compensator capacity requirement is reduced considerable, as the drill string only extends to the seabed and not into the well. However, having the riserless drill string in a fixed-to-bottom configuration is a precarious condition, in that the well will become open to the surrounding seawater if the drill string should fail, for example due to compensator malfunction. The reliability of the compensator system is therefore highly critical factor in this configuration.

The state of the art in drill string compensators includes a passive top-mounted drill string compensator (DSC) arranged at the top of the derrick. This drill string compensator is connected to the crown block (hence also often referred to as a "crown-mounted compensator", or "CMC"). It therefore addresses hook load variations directly and is able to reduce weight-on-bit variations during drilling to a minimum. The top mounted DSC/CMC is often supplemented by an active heave compensator cylinder which is used when landing subsea equipment such as BOPs, subsea trees, and during under-reaming and other downhole operations requiring a minimum of motion. The active heave compensator cylinder is mechanically connected to the crown block. Lifting operations are performed by a regular, non-compensated, drawworks. The CMC normally comprises a dual rocker-arm system (for the lifting drawworks) and is capable of handling dynamic loads that are significant compared to the static capacity of the derrick and crown block arrangement. For example, for a derrick, drawworks and CMC each having a static capacity on the order of 1279 tonnes, the CMC dynamic and active capacity is normally on the order of 680 tonnes, i.e. around 50% of the static capacity. The CMC passive cylinder is typically on the order of 7.6 metres.

Another known alternative to the above mentioned DSC/CMC is an active compensated drawworks, i.e. without a top-mounted DSC/CMC. This type of drawworks is typically driven by hydraulics or electrical motors, and the active compensation is performed by a controlled manipulation of the motors and/or hydraulics (pumps, control valves, etc.), based on input data from e.g. a vessel motion recording unit, and causing the drawworks to pay out or reel in wire. This system has no passive mode. An active compensated drawworks is also susceptible to mechanical malfunction, leading to a compete loss of drill string compensation. However, an active compensated drawworks is advantageous compared to the top mounted DSC/CMC in a weight and balance perspective: while the DSC/CMC is comparably heavy and positioned at the top of the derrick, the active compensated drawworks is lighter and arranged at deck level.

The present applicant has devised and embodied the invention in order to overcome shortcomings of the prior art and to obtain further advantages.

SUMMARY OF THE INVENTION

The invention is set forth and characterized in the main claim, while the dependent claims describe other characteristics of the invention.

It is thus provided a motion compensation system for controlling relative movements between a floating vessel and an elongate element, where the elongate element is suspended by the vessel at a first end and extends into a body of water below the floating vessel; characterized by an active motion compensator connected to the elongate element first end via an element arranged in an upper region of an erect support structure, and a passive motion compensator connected to the elongate element first end via the element, wherein the motion compensators are structurally and operationally separate and independent units and are configured for separate and mutually independent operation, and wherein the active motion compensator is configured for being at rest in a static state when the passive motion compensator is in operation, and vice versa.

In one embodiment, the passive motion compensator comprises one or more passive motion compensation cylinders.

The active motion compensator preferably comprises an active compensated drawworks placed on a deck on the floating vessel.

In one embodiment, the passive motion compensator comprises a first end which is connected to the element and a second end which is connected to the erect support structure, and wherein the element is movable in a guide structure.

The erect support structure comprises a support member for the element, on which the element rests when the passive motion compensator is not in operation and the active compensator is in operation.

In one embodiment, the passive motion compensator is supported by the erect support structure at a vertical distance above the active motion compensator.

When a second end of the elongate element is fixed to a bottom below the body of water, the active motion compensator is at rest and the passive motion compensator is operating.

Thus, by utilizing the combination of an active compensated drawworks and a passive top compensator having a reduced capacity compared to conventional top compensators, the risk of losing compensator capabilities in "fixed-to-bottom" operations is eliminated. The active compensated drawworks will handle operations where the drill string is not "fixed-to-bottom". In this mode the passive motion compensator is not in use and the crown block is resting on the water table, such that the loads are transferred directly into the derrick and not through the passive motion compensator.

BRIEF DESCRIPTION OF THE DRAWINGS

These and other characteristics of the invention will be clear from the following description of a preferential form of embodiment, given as a non-restrictive example, with reference to the attached schematic drawings wherein.

DETAILED DESCRIPTION OF A PREFERENTIAL EMBODIMENT

Figure 1:
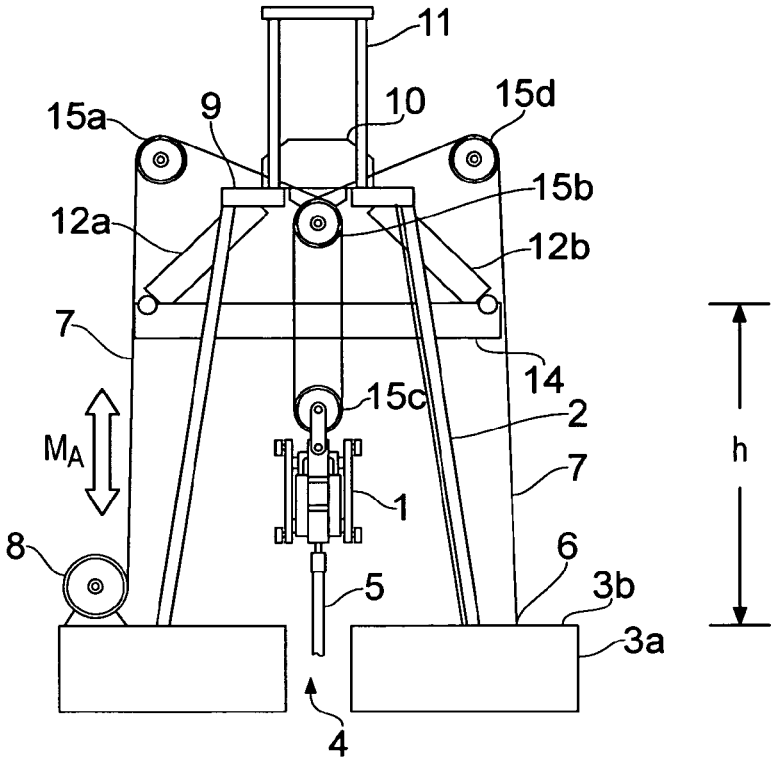
FIG. 1 illustrates the invented system in an active compensation mode.

FIG. 1 is a schematic illustration of the motion compensator system according to the invention in an active mode. A derrick 2 is supported by a floating vessel (indicated schematically as 3*a*) having a deck structure 3*b*. A drilling machine 1 is suspended by the derrick and controls a drill string 5 extending through a moon pool 4 and, into the water and to the seabed (not shown). This arrangement is well known in the art.

The drill string 5 is suspended by a crown block 10, via the drilling machine 1 and a wire-and-sheave arrangement 7, 15*b,c*. In this active compensation mode, the crown block 10 is resting on, and preferably bolted to, a watertable 9 in the derrick. A drawworks 8 is connected to the deck structure 3*b* and to the drilling machine 1 via a wire 7 running through sheaves 15*a-d* and to a connection point 6 on the deck structure (required power and control devices, hydraulic hoses, etc., have been omitted from the figure, as these items are well known in the art). Thus, the movement of (and hence motion compensation of) the drill pipe 5 is obtained by a controlled operation of the drawworks 8. The drawworks 8 is preferably an active compensated drawworks and dimensioned for handling the large loads associated with e.g. downhole operations when the drill string is not "fixed-to-bottom". This movement is indicated by the double-headed arrow $M_A$ in FIG. 1.

A passive motion compensator, schematically illustrated in the form of two passive compensator cylinders 12*a,b*, is connected between a support platform 14 in the derrick and the crown block 10 (required power and control devices, hydraulic hoses, etc., have been omitted from the figure, as these items are well known in the art). When the motion compensator system according to the invention is in the active mode, the passive motion compensator 12*a,b* is at rest and not in use. The crown block 10 is resting on the water table 9 and preferably firmly connected to it.

Figure 2:
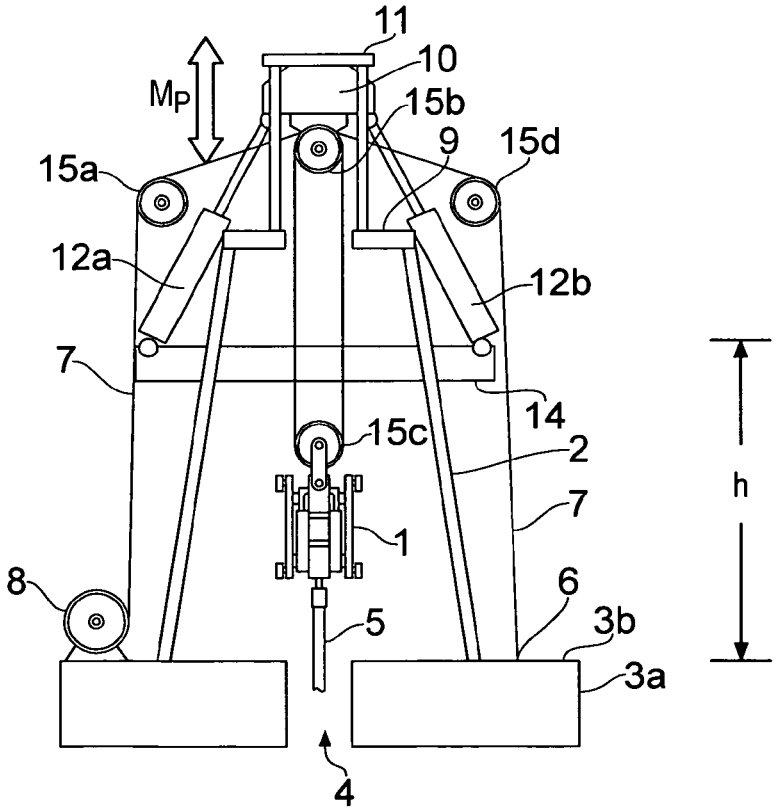
FIG. 2 illustrates the invented system in a passive compensation mode.

FIG. 2 is a schematic illustration of the motion compensator system according to the invention in a passive mode, which is used in a "fixed-to-bottom" configuration of the drill string. Here, the crown block 10 has been released from the water table 9 and is free to move up and down in the guide structure 11. The passive motion compensator 12*a,b* is in operation (indicated by double-headed arrow $M_P$) and set to compensate for the vessel movements. In this configuration, the drawworks 8 is operated as a convention drawworks. Thus, the drill string is compensated solely by a passive compensator 12*a,b* during the "fixed-to-bottom" operation.

The passive motion compensator 12*a,b* is designed for handling only the (comparatively) small loads associated with "fixed-to-bottom" operations. When the system is in an active compensation mode (e.g. for downhole operations, see FIG. 1), the passive motion compensator 12*a,b* is not taking any loads at all (the loads are transferred into the derrick via the crown block resting on the watertable). Therefore, the passive motion compensator 12*a,b* may be designed much slimmer and lighter than conventional drill string compensators. The requirements for cylinder stroke and load handling capabilities are reduced compared to the known CMCs. Also, rocker arms are not required. The new passive motion compensator does not need to be dimensioned for the derrick maximum load, as is the case with the known compensators. Referring to the example above for a known derrick, drawworks and CMC combination, the differences between the prior art and the invented system are illustrated by the following exemplary data:

| | Prior art | Invention |
|---|---|---|
| Derrick capacity (tonnes) | 1270 | 1270 |
| Drawworks capacity (tonnes) | 1270 | 1270 |
| Top compensator | | |
| static capacity (tonnes) | 1270 | 1270 |
| dynamic capacity (tonnes) | 680 | 150 |
| active capacity (tonnes) | 680 | n/a |
| stroke (metres) | 7.6 | 5 |

The invention claimed is:

1. A motion compensation system for controlling relative movements between a floating vessel and an elongate element, where the elongate element is suspended by the vessel at a first end and extends into a body of water below the floating vessel, comprising:

an active motion compensator connected to the elongate element first end via an element arranged in an upper region of an erect support structure; and a passive motion compensator connected to the elongate element first end via the element, wherein the motion compensators are structurally and operationally separate and independent units and are configured for separate and mutually independent operation, and wherein the active motion compensator is configured for being at rest in a static state when the passive motion compensator is in operation, and vice versa.

2. The motion compensation system of claim 1, wherein the passive motion compensator comprises one or more passive motion compensation cylinders.

3. The motion compensation system of claim 2, wherein the active motion compensator comprises an active compensated drawworks placed on a deck on the floating vessel.

4. The motion compensation system of claim 2, wherein the passive motion compensator comprises a first end which is connected to the element and a second end which is connected to the erect support structure, and wherein the element is movable in a guide structure.

5. The motion compensation system of claim 2, wherein the passive motion compensator is supported by the erect support structure at a vertical distance above the active motion compensator.

6. The motion compensation system of claim 2, wherein, when a second end of the elongate element is fixed to a bottom below the body of water, the active motion compensator is at rest and the passive motion compensator is operating.

7. The motion compensation system of claim 1, wherein the active motion compensator comprises an active compensated drawworks placed on a deck on the floating vessel.

8. The motion compensation system of claim 7, wherein the passive motion compensator comprises a first end which is connected to the element and a second end which is connected to the erect support structure, and wherein the element is movable in a guide structure.

9. The motion compensation system of claim 7, wherein the passive motion compensator is supported by the erect support structure at a vertical distance above the active motion compensator.

10. The motion compensation system of claim 7, wherein, when a second end of the elongate element is fixed to a bottom below the body of water, the active motion compensator is at rest and the passive motion compensator is operating.

11. The motion compensation system of claim 1, wherein the passive motion compensator comprises a first end which is connected to the element and a second end which is connected to the erect support structure, and wherein the element is movable in a guide structure.

12. The motion compensation system of claim 11, wherein the erect support structure comprises a support member for the element, on which the element rests when the passive motion compensator is not in operation and the active compensator is in operation.

13. The motion compensation system of claim 12, wherein the passive motion compensator is supported by the erect support structure at a vertical distance above the active motion compensator.

14. The motion compensation system of claim 12, wherein, when a second end of the elongate element is fixed to a bottom below the body of water, the active motion compensator is at rest and the passive motion compensator is operating.

15. The motion compensation system of claim 11, wherein the passive motion compensator is supported by the erect support structure at a vertical distance above the active motion compensator.

16. The motion compensation system of claim 11, wherein, when a second end of the elongate element is fixed to a bottom below the body of water, the active motion compensator is at rest and the passive motion compensator is operating.

17. The motion compensation system of claim 1, wherein the passive motion compensator is supported by the erect support structure at a vertical distance above the active motion compensator.

18. The motion compensation system of claim 17, wherein, when a second end of the elongate element is fixed to a bottom below the body of water, the active motion compensator is at rest and the passive motion compensator is operating.

19. The motion compensation system of claim 1, wherein, when a second end of the elongate element is fixed to a bottom below the body of water, the active motion compensator is at rest and the passive motion compensator is operating.

* * * * *